US006017254A

United States Patent [19]

Katayama et al.

[11] Patent Number: 6,017,254

[45] Date of Patent: Jan. 25, 2000

[54] COWLING FOR OUTBOARD MOTOR

[75] Inventors: Goichi Katayama; Kazuhiko Watanabe, both of Hamamatsu, Japan

[73] Assignee: Sanshin Kogyo Kabushiki Kaisha, Hamamatsu, Japan

[21] Appl. No.: 09/050,625

[22] Filed: Mar. 30, 1998

[30] Foreign Application Priority Data

Mar. 28, 1997 [JP] Japan ..... 9-077499

[51] Int. Cl.[7] ..... B63H 20/32

[52] U.S. Cl. ..... 440/77; 123/195 P

[58] Field of Search ..... 440/75, 77, 900; 123/195 P, 195 C

[56] References Cited

U.S. PATENT DOCUMENTS 4,661,076 4/1987 Iwai ..... 440/77

4,721,485 1/1988 Suzuki ..... 440/77

5,064,393 11/1991 Inoue .

*Primary Examiner*—Ed Swinehart

*Attorney, Agent, or Firm*—Knobbe, Martens, Olson & Bear LLP

[57] ABSTRACT

A cowling arrangement for an outboard motor for use in powering a watercraft is disclosed. The motor has an engine and a water propulsion device, the engine having an output shaft arranged to drive the water propulsion device. The engine has a body with a top end and a bottom end, the output shaft extending above the top end. A flywheel is connected to the output shaft at the top end of the engine, and a flywheel cover is positioned over the flywheel and supported by the engine body. The cowling defines an engine compartment in which the engine is positioned and has an opening therein. A starter panel is connected to the flywheel and supported solely thereby, the starter panel cooperating with the cowling to close the opening therein, the starter panel supporting at least one component of a starter for the engine.

12 Claims, 4 Drawing Sheets

COWLING FOR OUTBOARD MOTOR

FIELD OF THE INVENTION

The present invention relates to an outboard motor. More particularly, the invention is a cowling arrangement for such a motor.

BACKGROUND OF THE INVENTION

Watercraft are often powered by an outboard motor positioned at a stern of the craft. The outboard motor has a powerhead and a water propulsion device, such as a propeller. The powerhead includes a cowling in which is positioned an internal combustion engine, the engine having an output shaft arranged to drive the water propulsion device.

A starter mechanism is associated with the engine for use in starting the motor. In many instances, the starter mechanism comprises a manual starter. These starters generally include a pull handle connected to a first end of a cord. The second end of the cord wraps around a pulley or similar member connected to the output shaft of the engine. To start the engine, the operator of the motor grips the handle and extends the cord away from the engine. This action effects rotation of the pulley, and thus the output shaft of the engine, starting it.

In other instances, the motor is equipped with an electric starter. The starter has a pinion gear with teeth arranged to engage teeth on a flywheel mounted to the output shaft of the engine. A power source selectively provides power to the starter motor through a switch. In use, the operator engages the switch, powering the motor which turns the output shaft, starting the engine.

A problem arises in the manufacture of these types of motors in that while the motors are generally the same, some are equipped with manual starters, and some with electric starters. Those motors having manual starters have a cowling with an opening through which the handle of the manual starter extends. On the other hand, those motors equipped with electric starters have closed cowlings and are provided with a starter switch. Thus, during manufacture, two different cowling arrangements must be produced and the specific cowling for a given motor must be installed. This increases the cost and complexity of manufacturing these motors.

An improved cowling arrangement for an outboard motor which overcomes the above-stated problems is desired.

SUMMARY OF THE INVENTION

The present invention is a cowling arrangement for an outboard motor for use in powering a watercraft. The motor has an engine and a water propulsion device, the engine having an output shaft arranged to drive the water propulsion device.

The engine has a body with a top end and a bottom end, the output shaft extending above the top end. A flywheel is connected to the output shaft at the top end of the engine, and a flywheel cover is positioned over the flywheel and supported by the engine body.

The cowling defines an engine compartment in which the engine is positioned and has an opening therein. A starter panel is connected to the flywheel and supported solely thereby, the starter panel cooperating with the cowling to close the opening therein, the starter panel supporting at least one component of a starter for the engine.

Further objects, features, and advantages of the present invention over the prior art will become apparent from the detailed description of the drawings which follows, when considered with the attached figures.

DETAILED DESCRIPTION OF THE PREFERRED EMBODIMENTS OF THE INVENTION

Figure 1:
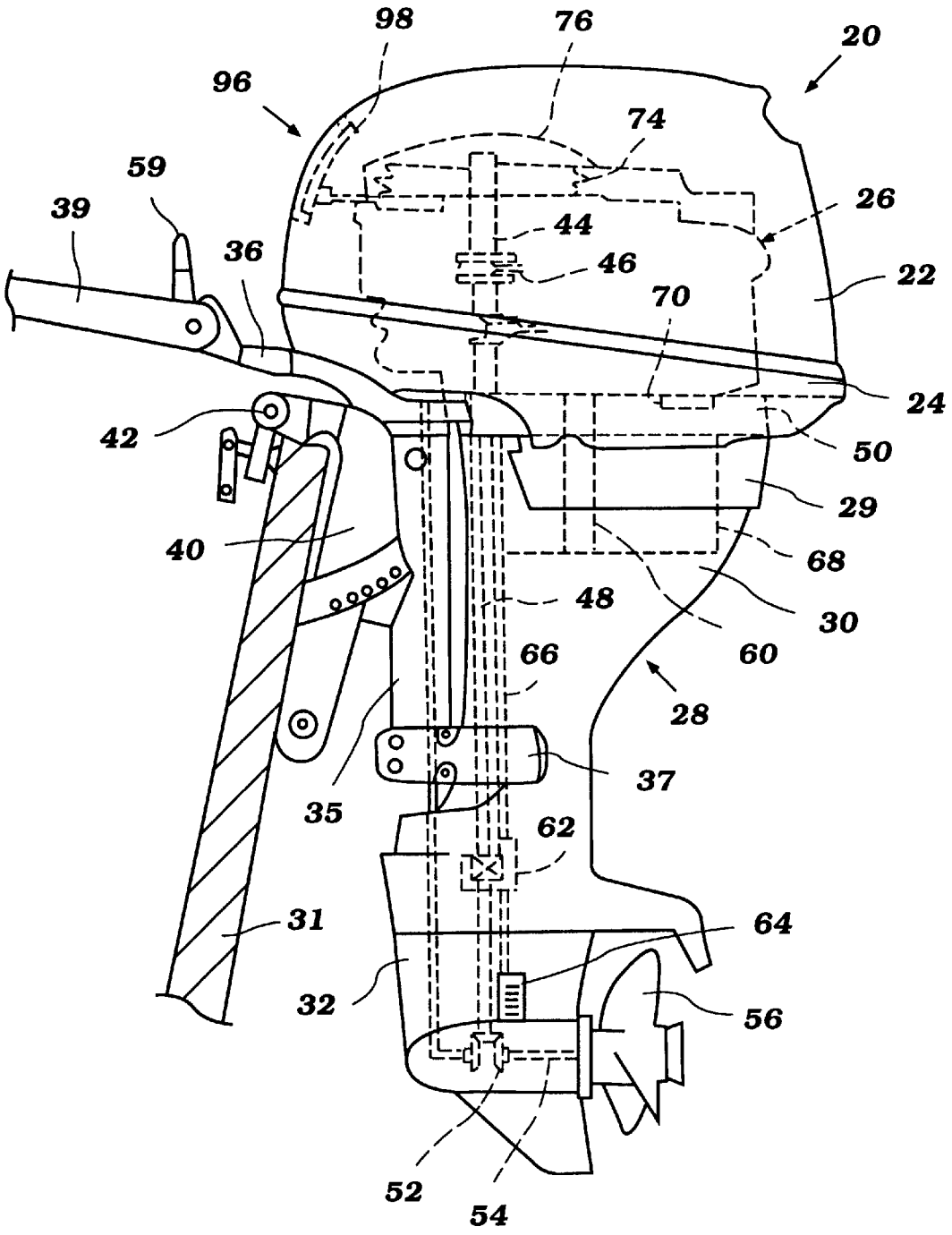
FIG. 1 is a side view of an outboard motor used to power a watercraft, the motor powered by an engine positioned in a cowling arranged in accordance with the present invention.

FIG. 1 illustrates an outboard motor 20 of the type with which the present invention is useful. The outboard motor 20 has a powerhead comprising a main cowling 22 with a lower cowling or tray 24 positioned therebelow. An internal combustion engine 26 is positioned in the powerhead.

A drive shaft housing or lower unit 28 depends below the powerhead. The drive shaft housing 28 comprises an upper casing 30 and a lower casing 32 positioned below the upper casing. A skirt 29 extends downwardly from the lower cowling 24 along a top portion of the upper casing 30.

The outboard motor 20 is arranged to be movably connected to a hull of a watercraft, preferably at a transom 34 portion of the watercraft at a stem thereof. In this regard, a steering or pivot shaft is connected to the motor 20. The steering shaft preferably extends along a vertically extending axis through a swivel bracket 35, the shaft connected to the motor 20 via at least one mount 37. The mounting of the steering shaft with respect to the swivel bracket 35 permits rotation of the motor 20 about the vertical axis through the bracket 35, so that the motor may be turned from side to side.

A steering bracket 36 is connected to a top end of the steering shaft. A steering handle 39 is connected to the steering bracket 36 and extends towards the watercraft 20. An operator of the motor 20 may move the outboard motor 20 from side to side with the handle 39, thus steering the watercraft to which the motor is connected.

The swivel bracket 35 is connected to the motor 20 via a clamping bracket 40 which includes a pivot pin 42 which extends along a generally horizontal axis. The clamping bracket 40 is arranged to be removably connected to the hull of a watercraft with a clamping screw or similar mechanism. The mounting of the motor 20 with respect to the clamping bracket 40 about the pin 42 permits the motor 20 to be raised up and down or "trimmed".

As described above, an engine 26 is positioned in the powerhead. The engine 26 may be of a variety of types. For example, the engine 26 may operate on a two or four-cycle principle, may have one or more cylinders, and may be arranged in in-line, "V" or other fashion. In the embodiment illustrated, the engine 26 has two cylinders arranged in in-line fashion.

The engine 26 has a body which defines the cylinders or combustion chambers. This body may comprise a cylinder head (not shown) connected to a cylinder block (not shown)

and cooperating therewith to define the two cylinders each having a combustion chamber.

As is well known in the art, a piston (not shown) is movably positioned cylinder and connected to a crankshaft or output shaft 44 via a connecting rod 46. As best illustrated in FIG. 1, the crankshaft 44 is generally vertically extending. As such, the cylinders, and thus the pistons, extend in a horizontal direction.

In the embodiment illustrated, the engine 26 is positioned above an exhaust guide 50. The crankshaft 44 extends below the bottom of the engine 26 in the direction of the drive shaft housing 28, where it is coupled to a drive shaft 48.

The drive shaft 48 extends through the drive shaft housing 28 and is arranged to drive a water propulsion device of the motor 20, preferably through a transmission 52. In the embodiment illustrated, the water propulsion device is a propeller 56 having a hub connected to a propeller shaft 54.

The transmission 52 may be arranged in a variety of fashions, as well known to those of skill in the art. Preferably, the transmission 52 is a forward-neutral-reverse transmission which selectively permits the drive shaft 48 to drive the propeller shaft 54.

In this arrangement, a shift lever 58 is provided on the steering handle 39. The shift lever 58 permits convenient shifting of the transmission 52 by the operator of the motor 20 from the watercraft.

Though not illustrated in detail, an intake system provides air to each cylinder of the engine 26 for the combustion process. A suitable fuel system, as well known to those of skill in the art, provides fuel to each cylinder for combustion with the air.

The engine 26 includes an ignition system. Such systems are well known to those of skill in the art, and thus the system is not described in detail herein. Preferably, however, the system includes a powered ignition coil which delivers a charge at a predetermined time to a spark plug corresponding to each cylinder. Each spark plug has its tip positioned in the cylinder, and when the charge is delivered to the spark plug, effects a spark across an electrode tip thereof to initiate the combustion of the air and fuel mixture in the cylinder.

A suitable exhaust system is provided for routing exhaust from each cylinder. Preferably, an exhaust passage (not shown) leads from each cylinder to a bottom of the engine 26. A connecting passage leads through the exhaust guide 50 to an exhaust pipe 60 which extends downwardly into a muffler area. The exhaust is then discharged from the motor 20 through an appropriate above or below the water port or passage.

Preferably, the motor 20 also includes a cooling system. This system includes a water pump 62 which is driven by the engine 26 by the drive shaft 48. The pump 62 draws water from the body of water in which the motor 20 is being operated through a inlet 64 in the lower unit 28. This water is delivered upwardly through a coolant supply pipe 66 to one or more coolant passages, such as in the engine body, around the exhaust muffler and the like. The coolant is then discharged back into the body of water through a discharge port.

The engine 26 includes a lubrication system. This system includes a lubricant or oil supply, such as oil in an oil pan 68. An oil pump 70 driven by the engine 26 draws oil from the pan 68 and delivers it through one or more galleries or passages of the engine 26.

Figure 2:
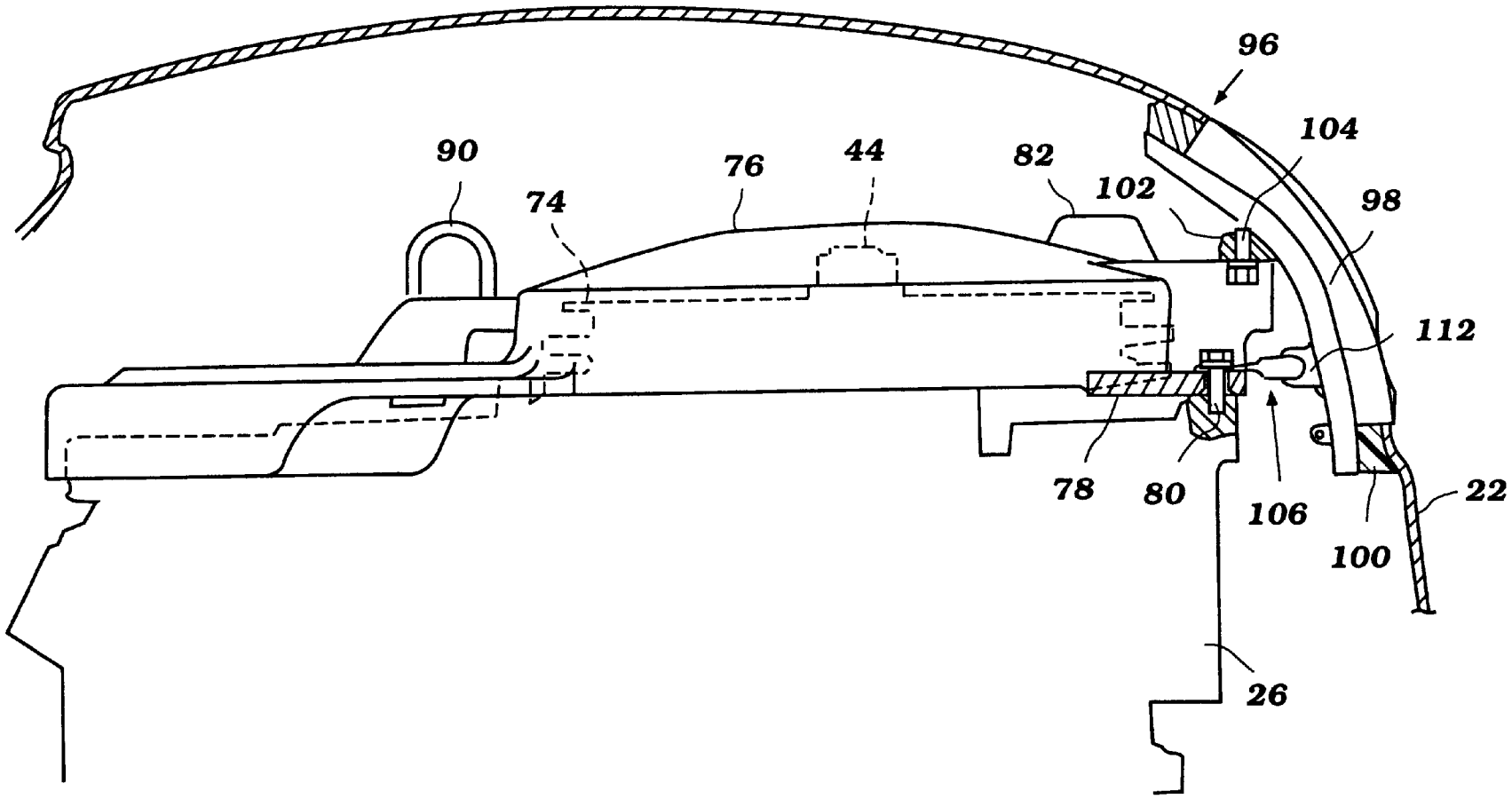
FIG. 2 is a cross-sectional side view of a powerhead portion of the motor illustrated in FIG. 1.

Referring to FIGS. 1 and 2, the crankshaft 44 extends above the top of the engine 26. A flywheel 74 is connected to the crankshaft 44 at this location. The flywheel 74 is preferably positioned under a flywheel cover 76 which is connected to and supported by the body of the engine 26. As illustrated, the cover 76 includes at least one bracket 78. A fastener 80 is utilized to fasten the bracket 78 to the engine body. Preferably, the fastener 80 is a bolt.

Means are preferably provided for starting the engine 26. Though not illustrated, the engine 26 may be provided with an electrically powered starter motor which has a pinion gear arranged to engage teeth on the flywheel 76. The starter motor is preferably housed beneath a starter motor cover 82 at the top end of the engine 26. This cover 82 may be formed integrally with the flywheel cover 76.

Alternatively, the engine 26 may be provided with a manual starter, such as a starter handle connected to a cord which wraps around a pulley connected to the flywheel 74. This manual starter may include a cord recoil mechanism. These types of manual starting mechanisms are well known to those of skill in the art.

Figure 3:
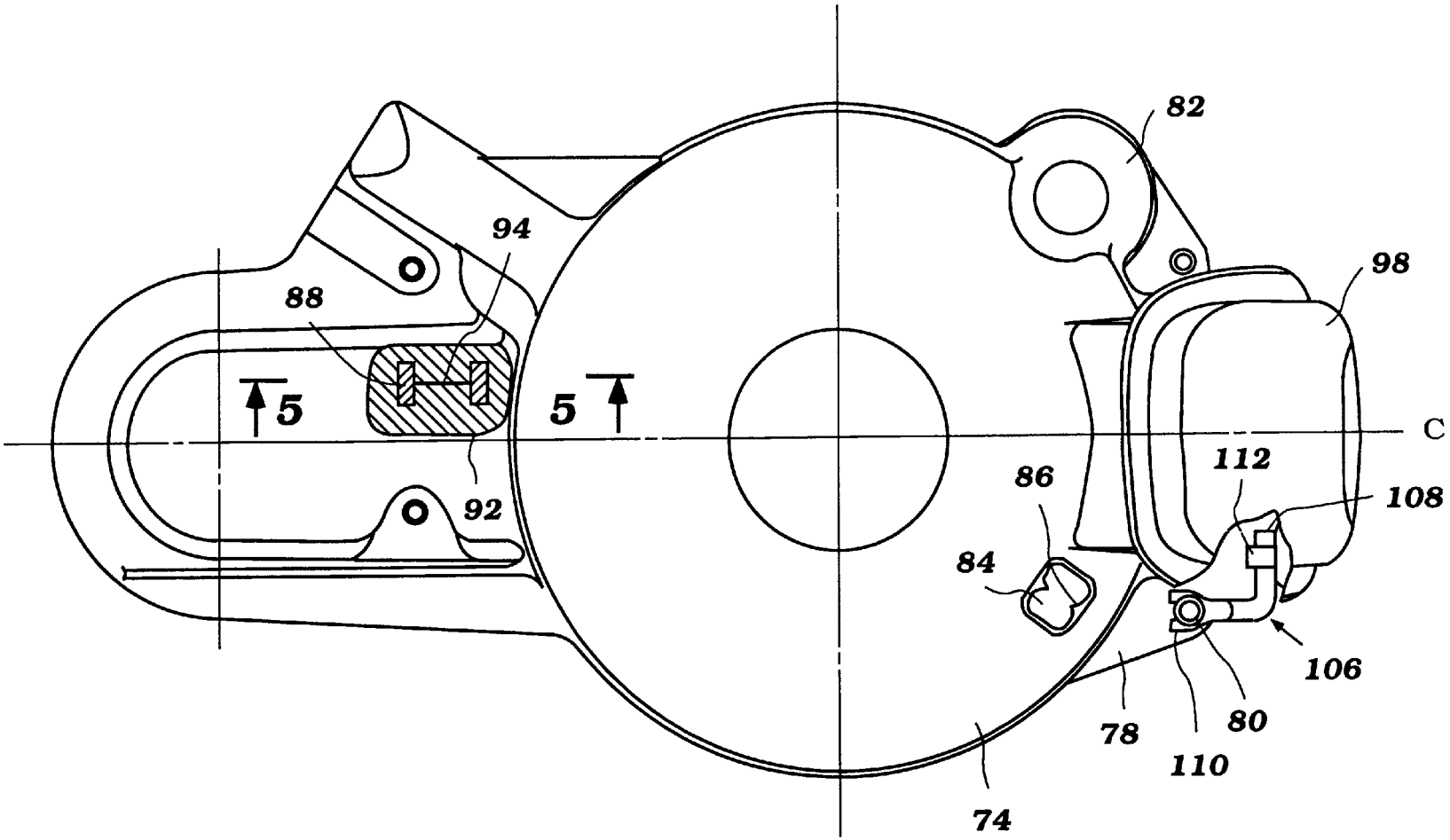
FIG. 3 is a top view of the motor illustrated in FIG. 2, with the cowling thereof removed to expose a flywheel cover and starter panel.

As illustrated in FIG. 3, a timing window 84 is provided in the flywheel cover 76. The window 84 may comprise an opening in the cover 76, or simply a section of the cover 76 which is relatively transparent, such as a section thereof constructed of clear plastic. Preferably, the window 84 is enclosed to prevent water from flowing through the flywheel cover 76. A calibrator, such pointer 86 or similar element, is preferably associated with this window 84 for alignment with one or more timing marks (not shown) provided on the flywheel 74. In this manner, the ignition timing of the engine 26 may be determined.

Figure 5:
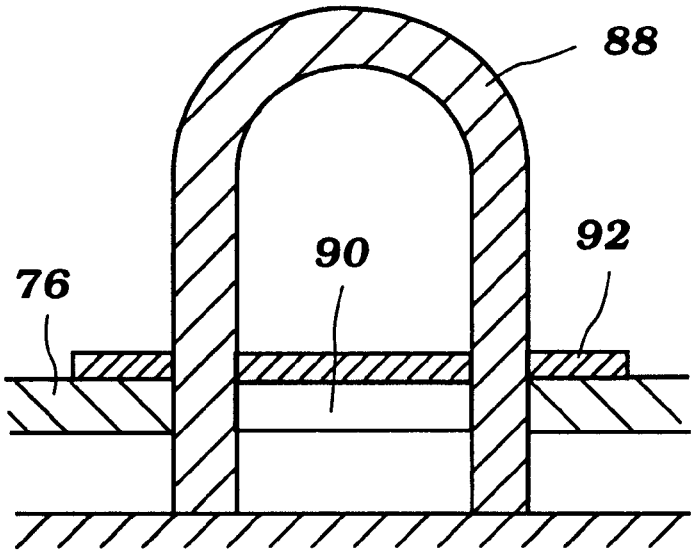
FIG. 5 is a cross-sectional view of an engine stay associated with the motor, taken along line 5—5 of FIG. 3.

Referring to FIGS. 2, 3 and 5, an engine stay 88 is illustrated. The stay 88 preferably comprises a member which is connected to the engine 26 and to which a lifting or supporting member may be connected. In the embodiment illustrated, the stay 88 is an inverted "U"-shaped member which has its ends connected to the body of the engine 26.

The stay 88 extends upwardly from the top end of the engine 26 through an opening 90 in the flywheel cover 76. A seal 92 is provided for sealing the opening 90 around the stay 88. Preferably, this seal 92 comprises a rubber member having a slit 94 therethrough. The seal 92 is connected to the flywheel cover 76 and extends across the opening 90. The stay 88 extends through the slit 94 outwardly of the cover 76. The seal 92 serves to prevent the entry of water through the opening 90 onto the flywheel 74 and the engine 26 therebelow.

In this arrangement, a lifting hook or the like may be connected to the looping end of the stay 88, permitting raising and lowering of the engine 26.

The particular cowling arrangement in accordance with the present invention will now be described in detail. Referring to FIGS. 1 and 2, an opening 96 is provided in the main cowling 22. This opening 96 is provided in that portion of the cowling 22 which faces the watercraft.

A starter panel 98 is removably coupled to the flywheel cover 76 and arranged to close the opening 96 in the cowling 22. The starter panel 98 has a size which is slightly larger than the opening 96. The starter panel 98 has a front surface and a rear surface. A seal 100 is positioned between the cowling 22 and front surface of the panel 98 for sealing the opening 96.

Preferably, the starter panel 98 is mounted to the engine 26 and not the cowling 22. As illustrated in FIG. 2, the panel 98 has at least one boss 102 extending from a rear surface thereof towards its top end. At least one fastener 104, such as a bolt, is arranged to connect the flywheel cover 76 and the boss 102.

In addition, at least one additional mounting member 106 is used to mount the panel 98. This mount 106 comprises a generally "L" shaped rod (see FIG. 3) having a first end 108 and a second end 110.

A mounting bracket 112 is connected to the rear surface of the panel 98 below the boss 102. As illustrated, the bracket 112 defines a central passage which extends generally perpendicular to a centerline C through the motor 20 from front to rear. The first end 108 of the mount 106 is arranged to pass through the passage defined by this bracket 112.

The second end 110 of the mount 106 is generally flat and is bifurcated, defining a opening. The bolt 80 which is used to fasten the flywheel cover 76 to the engine 26 preferably passes through the opening in this end 110 of the boss 102. The head or other engaging portion of the bolt 80 is arranged to press this second end 110 of the mount 106 against the bracket 78, securing it in place.

Figure 4:
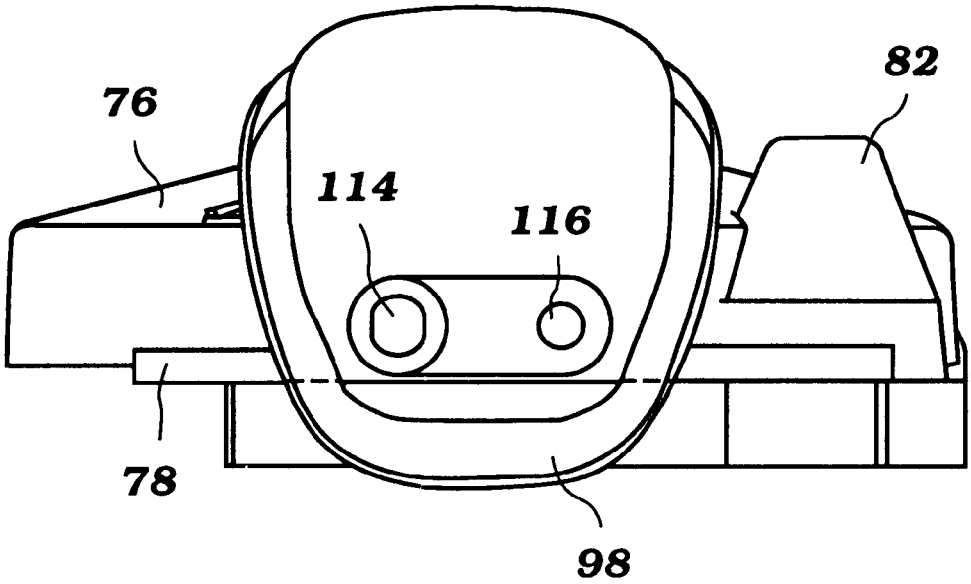
FIG. 4 is an elevational end view of the flywheel cover and starter panel illustrated in FIG. 3.

As illustrated in FIG. 4, a starter motor activation switch 114 and display lamp 116 are mounted to the panel 98. The switch 114 is positioned on the front side of the cover 98, and controls a switch which provides power to the starter motor. The lamp 116 is a light which is mounted at the front side of the panel 98. The lamp 116 may be arranged to illuminate when, for example, the engine is running.

The cowling in accordance with the present invention has several advantages. The cowling 22 is arranged so that only a single cowling needs to be produced, regardless of whether the motor 20 is provided with a manual or electric starter. In the instance where a manual starter is provided, a different manual starter panel may be connected to the flywheel cover 76 in place of the starter panel 98 described above. On the other hand, the panel 98 may be arranged so that when the starter button 114 is removed, the manual starter handle is supported thereby (for example, a cord guide may be mounted in the opening in which the starter button 114 is mounted, and the cord extended therethrough to the starter handle). In either case, the panel which is used to mount the starter button or handle is easily connected to the flywheel cover 76 and supported thereby. Because the panel 98 is not attached to the cowling 22, a single cowling 22 can be manufactured and used with a motor 20 having either a manual or electric starter.

While the fasteners 80, 104 have been described as bolts, other means may be used to fasten the members, such as clamps, clips, screws and the like. In addition, the specific configuration of the mounting member 106 and brackets may vary as appreciated by those of skill in the art. Of course, the foregoing description is that of preferred embodiments of the invention, and various changes and modifications may be made without departing from the spirit and scope of the invention, as defined by the appended claims.

What is claimed is:

1. An outboard motor and cowling arrangement for use in powering a watercraft, said outboard motor having an engine and a water propulsion device, said engine having an output shaft arranged to drive said water propulsion device, said engine having a body with a top end and a bottom end, said output shaft extending above said top end, a flywheel connected to said output shaft at said top end, a flywheel cover positioned over said flywheel and supported by said engine body, said cowling defining an engine compartment in which said engine is positioned, said cowling having an opening at an upper and forward side thereof, a starter panel connected to said flywheel cover and supported solely thereby, said starter panel having a portion juxtaposed to and cooperating with said cowling to close said opening therein, said starter panel supporting at least one component of a starter for said engine.

2. The outboard motor and cowling arrangement in accordance with claim 1, wherein said starter panel has a front surface and a rear surface, said front surface facing said opening in said cowling, and wherein a seal is provided between said cowling and said front surface of said starter panel.

3. The outboard motor and cowling arrangement in accordance with claim 1, wherein an electric starter button is mounted to said starter panel.

4. The outboard motor and cowling arrangement in accordance with claim 1, wherein said flywheel cover has a mounting bracket and at least one fastener connects said bracket to said body of said engine, and wherein said starter panel is also mounted to said engine with said at least one fastener.

5. The outboard motor and cowling arrangement in accordance with claim 4, including a mounting element having a first end connected to said starter panel and a second end mounted to said engine with said fastener.

6. The outboard motor and cowling arrangement in accordance with claim 5, wherein said mounting element is generally "L"-shaped.

7. The outboard motor and cowling arrangement in accordance with claim 2, wherein a boss extends from said rear surface and at least one fastener connects said boss to said flywheel cover.

8. The outboard motor and cowling arrangement in accordance with claim 1, wherein said opening faces a watercraft when said motor is connected thereto.

9. An outboard motor and cowling arrangement for use in powering a watercraft, said outboard motor having an engine and a water propulsion device, said engine having an output shaft arranged to drive said water propulsion device, said engine having a body with a top end and a bottom end, said output shaft extending above said top end, a flywheel connected to said output shaft at said top end, a flywheel cover positioned over said flywheel and supported by said engine, said cowling defining an engine compartment in which said engine is positioned, said cowling having an opening therein, a starter panel connected to said flywheel cover, said starter panel cooperating with said cowling to close said opening therein, said starter panel supporting at least one component of a starter for said engine, said starter panel including a mounting bracket, said flywheel including a mounting bracket connected to said engine body, and a mounting member connecting said bracket of said starter panel to said bracket of said flywheel cover.

10. The outboard motor and cowling arrangement in accordance with claim 9, wherein a seal is provided between said panel and said cowling.

11. The outboard motor and cowling arrangement in accordance with claim 9, wherein said mounting member is generally "L"-shaped.

12. The outboard motor and cowling arrangement in accordance with claim 9, wherein at least one starter component associated with a starter mechanism of said engine is supported by said starter panel.

* * * * *